United States Patent [19]

McConaghy, Jr.

[11] Patent Number: 4,698,147

[45] Date of Patent: Oct. 6, 1987

[54] SHORT RESIDENCE TIME HYDROGEN DONOR DILUENT CRACKING PROCESS

[75] Inventor: James R. McConaghy, Jr., Ponca City, Okla.

[73] Assignee: Conoco Inc., Ponca City, Okla.

[21] Appl. No.: 9,652

[22] Filed: Jan. 28, 1987

Related U.S. Application Data

[63] Continuation of Ser. No. 729,763, May 2, 1985, abandoned.

[51] Int. Cl.[4] ..... C10G 47/00

[52] U.S. Cl. ..... 208/107; 208/132; 208/145

[58] Field of Search ..... 208/107, 125, 132, 145

[56] References Cited

U.S. PATENT DOCUMENTS

| | | | |
|---|---|---|---|
| 2,843,530 | 7/1958 | Langer, Jr. et al. | 208/56 |
| 2,873,245 | 2/1959 | Thompson et al. | 208/56 |
| 2,900,327 | 8/1959 | Beuther | 208/132 |
| 2,953,513 | 9/1960 | Langer | 208/56 |
| 2,989,461 | 6/1961 | Eastman et al. | 208/107 |
| 3,224,959 | 12/1965 | Schlinger et al. | 208/107 |
| 4,002,556 | 1/1977 | Satchell, Jr. | 208/132 |
| 4,043,898 | 8/1977 | Kegler | 208/131 |
| 4,115,246 | 9/1978 | Sweany | 208/56 |
| 4,292,168 | 9/1981 | Derbyshire et al. | 208/107 |
| 4,389,303 | 6/1983 | Simo et al. | 208/56 |
| 4,430,197 | 2/1984 | Poynor et al. | 208/132 |
| 4,514,282 | 4/1985 | Poynor et al. | 208/56 |
| 4,640,762 | 2/1987 | Woods et al. | 208/107 |

FOREIGN PATENT DOCUMENTS

| | | | |
|---|---|---|---|
| 555631 | 4/1958 | Canada | 208/56 |

*Primary Examiner*—Andrew H. Metz
*Assistant Examiner*—Anthony McFarlane
*Attorney, Agent, or Firm*—Richard W. Collins

[57] ABSTRACT

Heavy hydrocarbon oil is subjected to hydrogen donor diluent cracking under conditions of high temperature, moderate pressure and short residence time.

3 Claims, 1 Drawing Figure

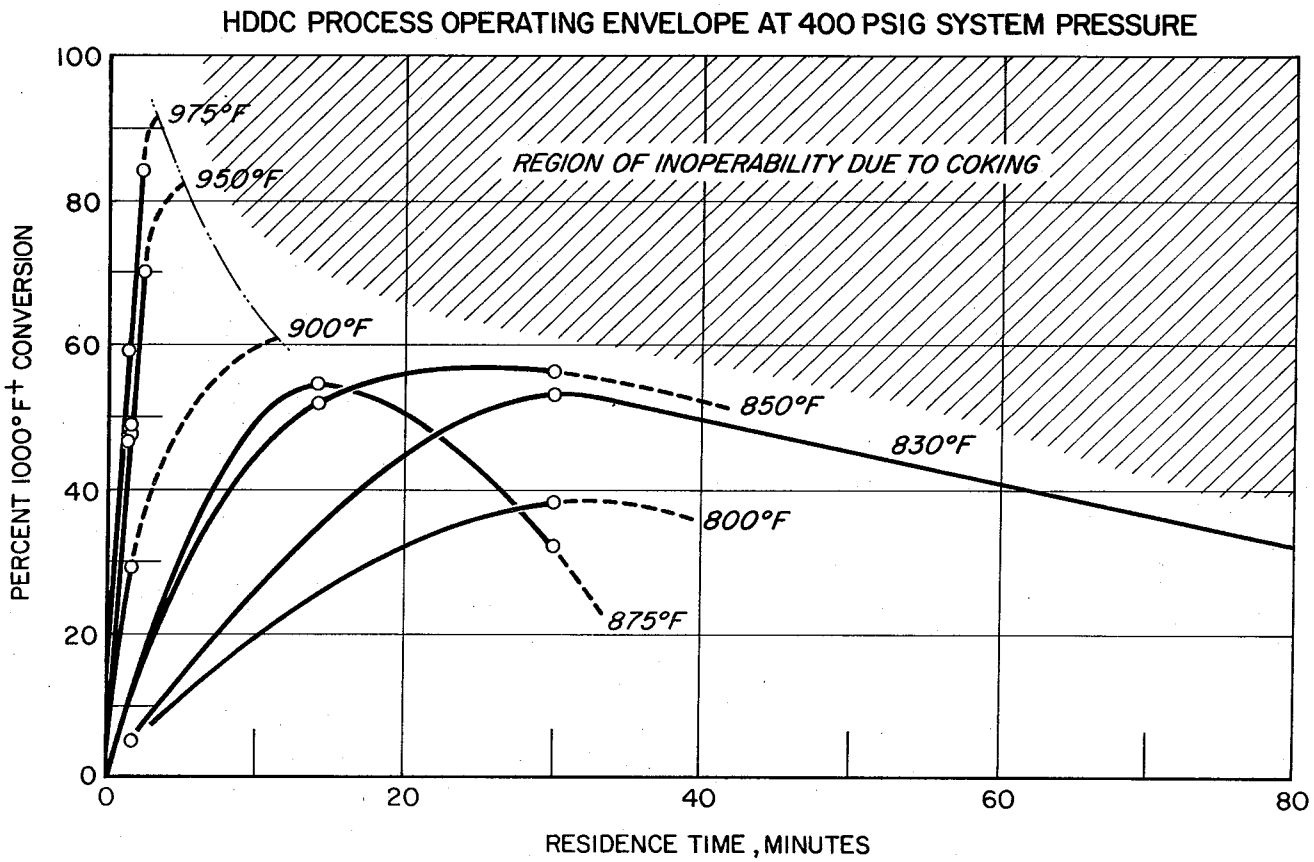
HDDC PROCESS OPERATING ENVELOPE AT 400 PSIG SYSTEM PRESSURE
REGION OF INOPERABILITY DUE TO COKING
975°F
950°F
900°F
850°F
830°F
800°F
875°F
PERCENT 1000°F+ CONVERSION
RESIDENCE TIME, MINUTES
0
20
40
60
80
100

SHORT RESIDENCE TIME HYDROGEN DONOR DILUENT CRACKING PROCESS

This application is a continuation of Ser. No. 729,763, filed May 2, 1985, now abandoned.

BACKGROUND OF THE INVENTION

1. Field of the Invention

This invention relates to conversion of heavy hydrocarbon oils into more valuable products, and more particularly relates to conversion of heavy hydrocarbon oils by an improved hydrogen donor diluent cracking process.

2. The Prior Art

Hydrogen donor diluent cracking (HDDC) of heavy hydrocarbon oils has been known for many years as a possible approach to upgrading of heavy hydrocarbon oils.

U.S. Pat. Nos. 2,873,245 and 2,953,513 both describe the HDDC process, and disclose wide ranges of potential operating conditions.

Canadian Pat. No. 555,631 describes use of hydrogen donor diluent in recovering oil from shale and tar sands.

Numerous other patents and literature references are directed to variations of HDDC. However, the HDDC process has not been widely utilized, partly due to the high capital costs associated with the high pressure equipment normally considered necessary for a commercial version of the HDDC process.

It is generally known that HDDC processes are more effective at higher temperatures, and that conversion yields are a function of reaction time. However, conversion at low temperature and long residence time can only be enhanced by increasing the system pressure with resultant high capital costs, while conversion at low pressure and high temperature is limited by unwanted formation of coke.

Prior to this invention, it has been generally believed that the HDDC process had to be carried out at low temperature (less than about 875° F.) and/or high pressure (greater than 1,000 psig). This belief probably resulted from the fact that exploratory work in this area was conducted in autoclaves, and the long heat up and cool down periods for autoclave work imposed a minimum on the reaction times that could be investigated. Long residence times lead to coke formation as the reaction temperature is increased.

It is an object of this invention to provide an HDDC process which does not require long residence times or high pressure, and which avoids the formation of coke.

It is a further object to provide an HDDC process which utilizes high temperature and short residence time at moderate pressure to provide high conversion yields without coke formation.

SUMMARY OF THE INVENTION

According to the present invention, heavy hydrocarbon oils are converted into lower boiling products by an HDDC process carried out at moderate pressure utilizing high cracking temperature and short residence time. The donor cracking reaction is carried out in a process furnace coil designed to attain the required combination of residence time and coil outlet temperature.

THE DRAWING

The drawing FIGURE is a graphical depiction of the results obtainable by carrying out an HDDC process at the conditions of the invention and at other less desirable conditions.

DESCRIPTION OF THE PREFERRED EMBODIMENTS

The present invention comprises an HDDC conversion process wherein a heavy hydrocarbon oil is admixed with a hydrogen donor diluent having a boiling range within the limits of 400° to 1000° F., and preferably in the range of 600° to 1000° F., and cracking the resulting mixture under specified conditions of temperature, pressure and residence time. The cracked mixture is then separated into spent donor diluent and products. The spent donor diluent is regenerated by partial hydrogenation and returned to the cracking step.

The heavy hydrocarbon oils that may be upgraded according to the present invention include whole crudes, heavy distillate and residual fractions therefrom, shale oils, heavy synthetic oils, coal tars, tar sand bitumen, etc. Preferred feedstocks are petroleum residua and tar sand bitumen.

The cracking conditions in accordance with the invention include those combinations of temperature, pressure and residence time sufficient to provide high conversions without coke formation. Preferred conditions are temperature of from 900° to 975° F., pressure of 200 to 1,000 psig, 0.4 to 2.0 parts by volume of diluent per part by volume of feed and residence time of less than three minutes. The upper temperature limit is set by constraints of furnace coil coking, and by increased light gas production, which sets an economic limit on the maximum cracking temperature for a particular feedstock.

Referring to the Drawing, conversion results for various feedstocks at various cracking temperatures are plotted as a function of residence time. As seen in the Drawing, conversions were limited to less than 60 percent for temperatures below 900° F. at the system pressure of 400 psig. However, at temperatures of 950° F. and higher, conversions of 70 percent and more were obtained at residence times of less than three minutes. Longer residence times at these high temperatures would result in coke formation. Data points on the Drawing were obtained using a variety of feedstocks and equipment.

The process of this invention is particularly suited to use of a furnace coil for the cracking step. The use of a furnace coil eliminates the need for a large pressure vessel, and eliminates mixing problems and dead spots prone to carbon deposition. Intermediate donor injection is feasible using a furnace coil. As used herein, the term "furnace coil" is intended to include any suitable tube configuration in a tubed process furnace.

The following Example is illustrative of the manner of obtaining the data depicted in the Drawing, and of the results obtained.

EXAMPLE I

A Ponca City vacuum resid comprising predominantly 1,000° F.+ material was mixed with donor diluent in a cracking coil and subjected to HDDC at 400 psig system pressure. Utilizing a residence time of 2.5 minutes and a cracking temperature of 975° F., a conversion of 1,000° F.+ material to 1,000° F.− material of 84 volume percent was obtained.

Similar experiments demonstrated that at high cracking temperatures and short residence times, high conversions could be obtained without coke formation.

I claim:

1. A hydrogen donor diluent cracking process consisting of the steps of:

(a) admixing partially hydrogenated hydrogen donor diluent and a heavy hydrocarbon oil feedstock;

(b) cracking said admixture in a furnace coil at a temperature of at least 900° F. and a pressure of not more than 1,000 psig, said cracking step extending for a residence time period in said furnace coil of not more than three minutes and until at least sixty volume percent of the feedstock material boiling above 1,000° F. is cracked to material boiling below 1,000° F.;

(c) separating the cracked material from step (b) into spent donor diluent and products;

(d) regenerating said spent donor diluent by partial hydrogenation;

(e) recovering said products; and (f) returning said regenerated donor to said cracking step.

2. The process of claim 1 wherein said cracking temperature is at least 950° F.

3. The process of claim 1 wherein said feedstock is petroleum residuum, said cracking is not carried out at a temperature of at least 950° F. and a pressure of not more than 400 psig, and said feedstock is at least 70 percent by volume cracked to material boiling below 1,000° F.

* * * * *